United States Patent [19]

Anagnostidis

[11] 4,023,696

[45] May 17, 1977

[54] BOTTLES FOR COMPRESSED GASES OF AU6MGT

[75] Inventor: Marc Anagnostidis, Chamalieres, France

[73] Assignee: Societe Metallurgique de Gerzat, Paris, France

[22] Filed: July 29, 1974

[21] Appl. No.: 492,905

[52] U.S. Cl. ..... 220/3; 75/142; 148/32.5; 148/11.5 A; 148/159

[51] Int. Cl.[2] ..... F25J 5/00

[58] Field of Search ..... 148/32.5, 11.5 A, 159; 75/142; 220/3

[56] References Cited

UNITED STATES PATENTS 3,414,406 12/1968 Doyle et al. ..... 148/159

FOREIGN PATENTS OR APPLICATIONS 1,379,764 10/1964 France ..... 148/11.5 A

*Primary Examiner*—Arthur J. Steiner

*Attorney, Agent, or Firm*—McDougall, Hersh & Scott

[57] ABSTRACT

Bottles for compressed gases of AU6MGT with good mechanical properties and resilience, coupled with resistance to intercrystalline corrosion and to corrosion under tension. These bottles are obtained by drawing on a mandrel, in the absence of supports or, better still, by the combined drawing of an extruded blank, quenched and aged, comprising a cylindrical part and a base, followed by tapering of the end at a temperature of from 350° to 400° C, the propagation of heat towards the cylindrical part being prevented by means of a cooling ring, and finally by quenching in cold water until cooling is complete. The bottles obtained by this method are extremely safe to use and satisfy the most stringent requirements, in particular in the field of aviation, space vehicles and in every case where it is desired to combine minimal weight with good resilience and high resistance to corrosion.

8 Claims, 3 Drawing Figures

BOTTLES FOR COMPRESSED GASES OF AU6MGT

Figure 1:
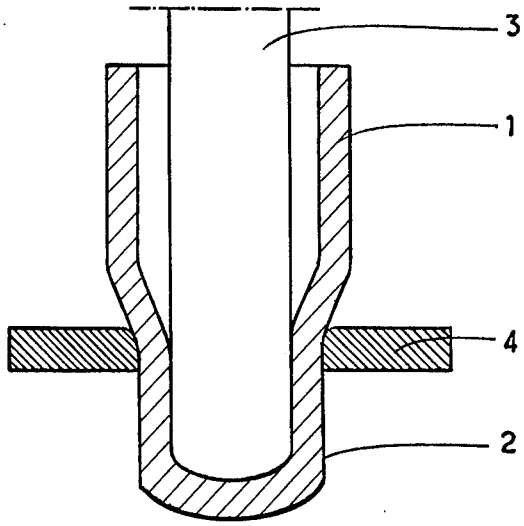
Figure 3:
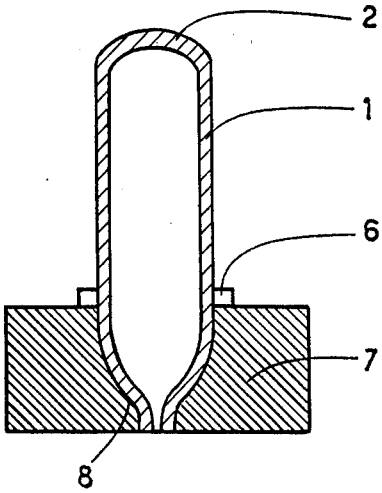
Figure 2:
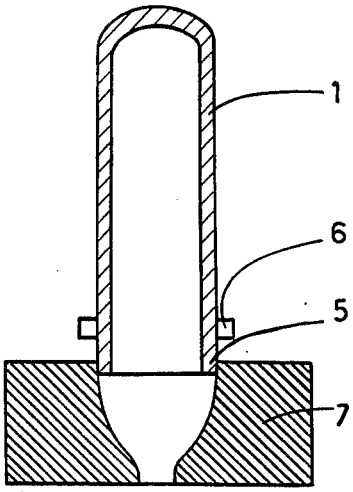

This invention relates to containers of aluminum-based alloy which are able to withstand high internal pressures, and more particularly to bottles for compressed gases.

It is known that bottles for compressed gases can be produced from an aluminum-based alloy known by the symbol AU6MGT according to French Standards AFNOR A 02001 and A 02002. This alloy has the following composition:

| | |
|---|---|
| Copper | 5 to 7% |
| Manganese | 0.05 to 0.50% |
| Magnesium | 0.10 to 0.50% |
| Titanium | 0.05 to 0.25% |
| Iron | 0.50% |
| Silicon | 0.30% |
| Aluminum | balance to 100% |

French Pat. No. 1,379,764 for example describes the manufacture of bottles for compressed gases from AU6MGT.

The bottles obtained by the process described in this patent do not have the necessary resilience properties to satisfy the extremely stringent fragility tests applied under certain regulations.

The tests in question include, in particular, bursting tests under internal air pressure without shattering of the bottle, and crushing or flattening tests between two standard wedges placed perpendicularly of the generatrices of the bottle.

The use of AU6MGT treated as described in the aforementioned patent, i.e. solution heat treated for 1 to 3 hours at 510°/540°C, quenched in water and tempered at 175° C over a period of 24 hours, always leads to negative results for these two tests.

None of the other aluminum alloys which have been tested for manufacturing bottles for compressed gases satisfies the following four requirements at the same time:

1. A high resilience, characterized for example by the two above tests or by modern fragility tests, such as studying crack proopagation energy.

This test, known as MANLABS or PHYSMET, from the name of the American Company which manufactures the necessary equipment, has been the subject of considerable development over the past few years in aeronautical laboratories and in the advanced research laboratories of Aluminum Pechiney. It uses test specimens of the CHARPY V type, in which the conventional notch is extended by a fatigue crack, and comprises determining the breaking energy by impact flexing or by gradual flexing. By varying the depth of the cracks, it is possible to trace the curve giving the value of the resiliences as a function of the depth of the crack.

By extrapolating this curve, it is possible to deduce the energy absorbed by a bar containing an infinitesimally small fatigue crack.

This energy, expressed as $E_{co}$, is considered to be indicative of the crack propagation resistance of materials. It is more or less lower than the energy $E_{nc}$ required to break a test specimen of CHARPY V type notched by machining, but not cracked.

2. A very high resistance to intercrystalline corrosion.

3. A high resistance to corrosion under tension.

4. Good mechanical properties allowing a bottle of minimum weight to be obtained.

We have found that AU6MGT can be subjected to combined heat and mechanical treatment in such a way that it is possible to obtain bottles showing all four of the aforementioned properties at the same time.

The present invention relates to containers which have to withstand high internal pressures and more particularly, to bottles for compressed gases of AU6MGT, distinguished by an ultimate tensile strength of more than 46 hbars, a yield strength of more than 39 hbars, an elongation of more than 15% (with a distance between marks of 5.65 So), So being the initial section of the test specimen, a crack propagation energy $E_{co}$ of more than 6 joules (as measured by the resilience test on test specimens cracked by fatigue, using 10 × 5 mm test specimens), an excellent resistance to intercrystalline corrosion and a remarkable resistance to corrosion under tension under a stress equal to or greater than 85% of the yield strength.

The invention also relates to a method of manufacturing containers which have to withstand high internal pressure, more especially bottles for compressed gases of AU6MGT, showing the properties which have just been described from an extruded blank comprising the cylindrical part and the base.

According to the invention, the blank is subjected successively to a solution heat treatment for 1 to 4 hours at 510°/540° C, to quenching in water, to natural aging for several days (betwen 3 and 12 days, but preferably for 8 days) at ambient temperature which can be accelerated by heating for a few hours at a temperature below 130° C, preferably for 24 hours at a temperature of 100° C, and then to cold-working at a rate of from 3 to 50% by drawing the blank first unsupported and then on a mandrel which provides the blank with its final dimensions by reducing its initial diameter by from 2 to 10%.

The invention also relates to a method of tapering under heat by heating to 350°/400° C that section intended to form the taper with the interposition of a water-circulation ring preventing the heat from spreading towards the remaining cylindrical part, followed by quenching in cold water of the tapered bottle until it has completely cooled.

As a result of efforts to improve bottles of a AU6MGT manufactured by known methods, I have found that the cold-working of a tapered bottle by drawing in the absence of any support produced extremely satisfactory mechanical characteristics, but gave rise to the formation of creases and bulges near the base, altering the appearance of the end product. By contrast, drawing of the blank on a mandrel before tapering produced bottles without any external faults, but with less elongation than that produced by drawing in the absence of any support (approximately 12%), the crack propagation energy $E_{co}$ remaining extremely high.

I have now perfected a process which obviates the disadvantages of these two methods while retaining their respective advantages, namely a process in which drawing in the absence of a support is combined with drawing on a mandrel and which enables remarkable mechanical properties to be obtained without any adverse effect upon resistance to corrosion.

6 joules, as determined by the PHYSMET test on test specimens measuring 10 × 5 mn, an excellent resistance to corrosion under tension under a stress equal to or greater than 85% of the yield strength.

4. The method as claimed in claim 1 wherein aging of the extruded blank is accelerated by heating for a few hours at a temperature below 130° C.

5. The method as claimed in claim 1 in which the blank is subjected to natural aging for 3 to 12 days.

6. The method as claimed in claim 1 in which the blank is cold worked to a level of from 15 to 20%.

7. The method as claimed in claim 1 in which the initial diameter of the blank is reduced by 4 to 5%.

8. The method as claimed in claim 4 in which the aging is accelerated by heating the blank for about 24 hours at a temperature of about 100° C.

* * * * *

UNITED STATES PATENT OFFICE

CERTIFICATE OF CORRECTION

Patent No. 4,023,696 Dated May 17, 1977

Inventor(s) Marc Anagnostidis

It is certified that error appears in the above-identified patent and that said Letters Patent are hereby corrected as shown below:

Column 5, line 3, after "resistance" insert

-- to intercrystalline corrosion and a remarkable resistance --

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*